US008967421B2

(12) United States Patent
Starkey-Johnson et al.

(10) Patent No.: US 8,967,421 B2
(45) Date of Patent: Mar. 3, 2015

(54) CONTAINER SECURING BASE AND TRAY

(71) Applicants: Debra Starkey-Johnson, Crown Point, IN (US); Duane Marks, Indianpolis, IN (US)

(72) Inventors: Debra Starkey-Johnson, Crown Point, IN (US); Duane Marks, Indianpolis, IN (US)

(73) Assignee: Debra J. Starkey-Johnson, Crown Point, IN (US)

( * ) Notice: Subject to any disclaimer, the term of this patent is extended or adjusted under 35 U.S.C. 154(b) by 22 days.

(21) Appl. No.: 13/678,848

(22) Filed: Nov. 16, 2012

(65) Prior Publication Data

US 2013/0119073 A1 May 16, 2013

Related U.S. Application Data

(60) Provisional application No. 61/560,754, filed on Nov. 16, 2011, provisional application No. 61/620,602, filed on Apr. 5, 2012.

(51) Int. Cl.

| | |
|---|---|
| ***B65D 25/24*** | (2006.01) |
| ***B65D 25/00*** | (2006.01) |
| ***B44D 3/00*** | (2006.01) |

(52) U.S. Cl.

CPC . *B65D 25/00* (2013.01); *B44D 3/00* (2013.01)
USPC ..... 220/630; 220/570; 206/564

(58) Field of Classification Search

USPC ..... 220/630, 636, 628, 23.89, 270, 556, 220/558, 559, 571, 571.1, 610, 623, 625, 220/212, 570, 560.03, 553, 555; 206/564, 206/565; 248/310, 346.01, 346.03, 346.04, 248/346.11, 346.5

See application file for complete search history.

(56) References Cited

U.S. PATENT DOCUMENTS

| | | | | | |
|---|---|---|---|---|---|
| 864,556 | A | | 8/1907 | Reiter | |
| 1,595,356 | A | * | 8/1926 | Moseman | 220/23.8 |
| 2,060,543 | A | * | 11/1936 | White | 248/346.04 |
| 2,107,381 | A | * | 2/1938 | Leppke | 220/23.83 |
| 2,150,965 | A | | 3/1939 | Doty | |
| 2,518,214 | A | * | 8/1950 | Worthington | 220/630 |
| 2,550,713 | A | | 5/1951 | Nicholson | |
| 2,565,793 | A | * | 8/1951 | Weismantel | 248/362 |
| 2,813,509 | A | * | 11/1957 | Bruno | 119/51.01 |
| 2,856,095 | A | | 10/1958 | Schnabel | |
| 2,878,932 | A | * | 3/1959 | Martire, Jr. | 206/564 |
| 2,936,926 | A | * | 5/1960 | Miller | 220/571 |
| 2,997,199 | A | * | 8/1961 | Reachi | 220/23.86 |
| 3,107,028 | A | * | 10/1963 | De Robertis | 220/212 |
| 3,352,450 | A | | 11/1967 | Rawlins | |
| 3,407,429 | A | | 10/1968 | Di Nardo | |
| 3,853,297 | A | * | 12/1974 | Drolet | 248/412 |
| 4,047,329 | A | * | 9/1977 | Holt | 47/65.7 |
| 4,071,163 | A | * | 1/1978 | Martin | 220/630 |
| 4,574,969 | A | * | 3/1986 | Mays | 220/8 |
| 4,930,653 | A | * | 6/1990 | Machado | 220/23.4 |
| 5,092,652 | A | * | 3/1992 | Macaluso | 297/146 |
| 5,558,391 | A | * | 9/1996 | Chavous | 297/153 |

(Continued)

*Primary Examiner* — Fenn Mathew
*Assistant Examiner* — Robert Stodola
(74) *Attorney, Agent, or Firm* — Faegre Baker Daniels LLP

(57) ABSTRACT

A container base and tray has a container securing portion and a tray or tote portion. The container securing portion secures a container, such as a paint container, to the base and allows a user to transfer the container base and tray (when the container is secured thereto) by way of the container handle. The container securing portion and the tray or tote portion may comprise a single component or may comprise separate, connectable, components. In one embodiment, the tray may secure containers having different sized bases.

19 Claims, 13 Drawing Sheets

(56) References Cited

U.S. PATENT DOCUMENTS

| | | | | |
|---|---|---|---|---|
| 5,743,505 | A * | 4/1998 | Sofy | 248/346.01 |
| 5,759,275 | A | 6/1998 | Shostak | |
| 6,227,513 | B1 * | 5/2001 | Richard | 248/346.07 |
| 6,302,361 | B1 * | 10/2001 | Schaefer et al. | 248/27.3 |
| 6,971,420 | B2 | 12/2005 | Dermity | |
| 7,044,291 | B1 * | 5/2006 | Mumford | 206/81 |
| 7,201,440 | B2 * | 4/2007 | Heck et al. | 297/148 |
| 7,527,164 | B1 | 5/2009 | Reichborn | |
| 8,657,144 | B2 * | 2/2014 | Kells | 220/570 |
| 2004/0016855 | A1 * | 1/2004 | Berry et al. | 248/146 |
| 2004/0099675 | A1 * | 5/2004 | Peck | 220/737 |
| 2008/0149580 | A1 * | 6/2008 | Hill | 211/126.1 |
| 2008/0190948 | A1 * | 8/2008 | Sayasithsena | 220/737 |
| 2009/0139890 | A1 * | 6/2009 | Hatcher | 206/457 |
| 2010/0221390 | A1 * | 9/2010 | Madonia | 426/104 |
| 2011/0056958 | A1 * | 3/2011 | Lalwani | 220/574 |
| 2012/0168591 | A1 * | 7/2012 | Cimaglio | 248/346.04 |

* cited by examiner

CONTAINER SECURING BASE AND TRAY

CROSS-REFERENCE TO RELATED APPLICATIONS

This application claims the benefit under 35 U.S.C. §119 (e) of U.S. Provisional Patent Application Ser. Nos. 61/560,754 filed Nov. 16, 2011 and 61/620,602 filed Apr. 5, 2012, the disclosures of which are hereby incorporated by reference in their entirety.

FIELD

The present disclosure relates generally to a tray for use with containers. More specifically, the present disclosure relates to trays and totes for holding tools and a container.

DESCRIPTION OF THE RELATED ART

Paints, primers, stains, solvents, water-proofing compounds, sealers, and the like, are generally sold in containers ranging in size from a pint to ten or more gallons. The containers holding these liquids generally have an opening at the top, from which the contents (such as paint) may be removed. For example, in order to utilize paint within a paint container, paint may be poured from a container into a paint tray or a worker may dip a brush or roller into the paint within the container.

Accessing and applying any of these liquids can create unintended messes, for example, dripping caused by dripping from the brush (or roller), splatters when removing the liquid from the container, and the liquid running down the sides of the container. In order to avoid these unintended messes, a drop cloth may be placed under the container and in the area where the liquid is being applied. However, whenever the worker needs to change locations, for example to apply paint on a different wall or in a different room, the container is moved separate of the drop cloth. Thus a worker must move the container, risking accidental messes, and then move (and re-position) the drop cloth at the new location. This process is not only cumbersome and inefficient, but also poses additional opportunities for creating unintended messes.

SUMMARY

The present disclosure provides a tray or tote for a liquid container having a container securing portion and a tray or tote portion. According to some embodiments of the disclosure, the container securing portion has an outer and inner securing portion which define a groove and which function together to secure a container, such as a paint container, to the container securing portion. The tray or tote portion is disposed around, and extends outwardly from, the container securing portion. Additionally, the tray or tote portion includes a raised outer edge. According to some embodiments of the present disclosure, the tray or tote also includes a container release component which is disposed adjacent to the outer securing portion of the container securing portion and aides in releasing a container secured within the container securing portion.

According to some embodiments of the present disclosure, the tray or tote portion may include a plurality of compartments defined by one or more tray compartment separators. Additionally, the tray floor of the tray or tote portion may be sloped, such that it slopes downward towards the outer edge.

In some embodiments, the outer edge of the tray or tote portion may also include or define a grip region. Additionally, a handle may be provided.

According to further embodiments, the tray or tote may include one or more securing brackets which act to exert an inward force on outer can securing portion. The securing bracket may be spring loaded and may rotate about a pivot pin when a downward force is exerted on an outward portion of the securing bracket by a container release component.

According to still further embodiments, the tray or tote may include one or more compartments for storing tools. In yet still further embodiments, the tray may include a plurality of means to secure containers having different sized bases.

In one exemplary embodiment of the present disclosure, a base for a container is provided. The base comprises a container securing portion having an outer securing portion and an inner securing portion, the outer and inner securing portions defining a groove, the container securing portion coupling a container to the container securing portion; a surrounding portion extending outwardly from the container securing portion, the surrounding portion disposed around the container securing portion; and a container release component disposed adjacent the outer securing portion of the container securing portion.

In another exemplary embodiment of the present disclosure, a base for a container is provided. The base comprises means for securing a container to the base; a surrounding portion extending outwardly from the securing means, the surrounding portion disposed around the securing means; and means for releasing the container from the base positioned adjacent the securing means.

In still another exemplary embodiment of the present disclosure, a base for a container is provided. The base comprises a container receiving portion having a first cylindrical sleeve configured to secure a first container having a first diameter and a second cylindrical sleeve positioned concentrically with the first cylindrical sleeve, the second cylindrical sleeve configured to secure a second container having a second diameter different than the first diameter. and a surrounding portion extending outwardly from the container securing portion, the surrounding portion disposed around the container securing portion.

In even further embodiments, container securing portion and tray portion may comprise separate, connectable, portions of tray. In some such embodiments, tray portion may define one or more connection apertures, within tray floor, which allows tray connecting extensions to pass therethough. According to such embodiments, tray portion also defines a container securing portion aperture, within tray floor, which allows a container to pass therethrough.

BRIEF DESCRIPTION OF THE DRAWINGS

The features of this disclosure, and the manner of attaining them, will become more apparent and the disclosure itself will be better understood by reference to the following description of embodiments of the disclosure taken in conjunction with the accompanying drawing.

Figure 1:
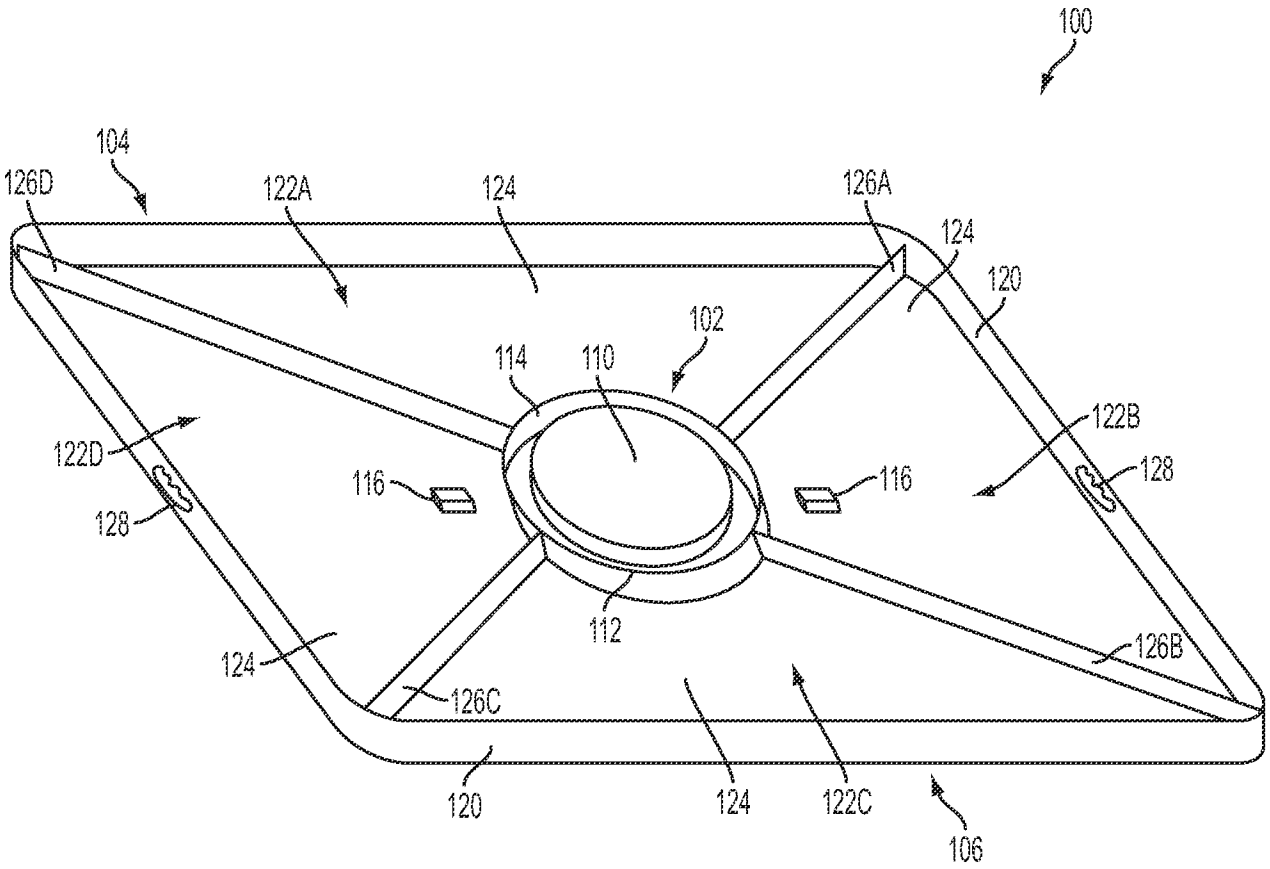
FIG. 1 is a perspective view of an exemplary embodiment of a container base and tray according to the instant disclosure.

Corresponding reference characters indicate corresponding parts throughout the several views. Although the drawings represent embodiments of the present disclosure, the drawings are not necessarily to scale and certain features may be exaggerated in order to better illustrate and explain the present disclosure. The exemplifications set out herein illustrate an exemplary embodiment of the disclosure, in one form, and such exemplifications are not to be construed as limiting the scope of the disclosure in any manner.

DETAILED DESCRIPTION OF THE DRAWINGS

The embodiments disclosed herein are not intended to be exhaustive or limit the disclosure to the precise form disclosed in the following detailed description. Rather, the embodiments are chosen and described so that others skilled in the art may utilize their teachings.

With reference to FIG. 1, an exemplary embodiment of container base and tray 100 is depicted. Although depicted as comprising a square, it should be understood that container base and tray 100 may comprise any shape, including but not limited to a rectangle, an oval, a circle, and any other polygonal shape. Additionally, although discussed herein generally as being used with a liquid or paint container, it should be understood that the embodiments of container base and tray 100 disclosed herein may also be used with a container having contents of any physical state including solids (such as concrete mix), plasma, and various other liquids.

Figure 6:
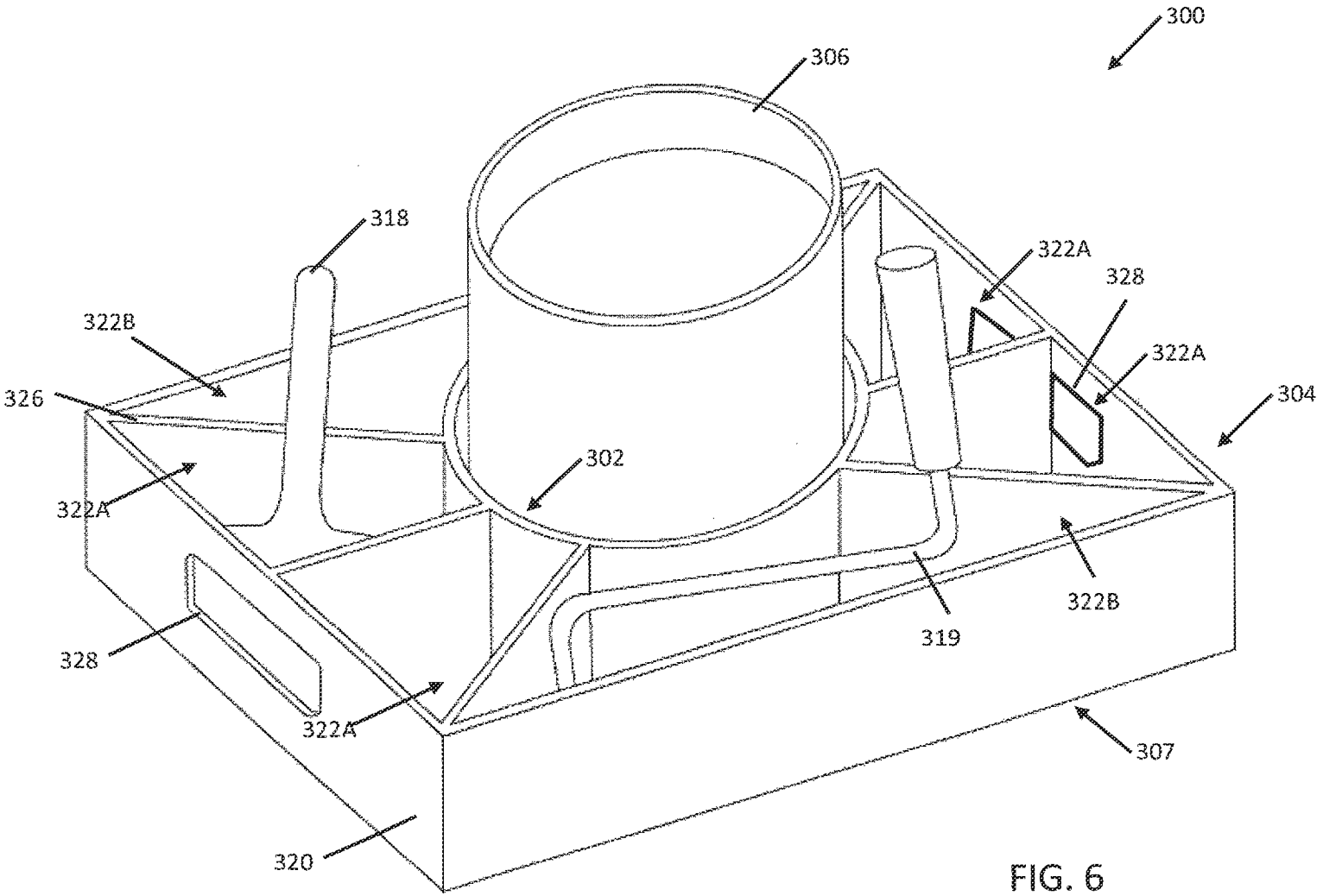
FIG. 6 is a perspective view of an exemplary embodiment of a container base and tote according to the instant disclosure.

As shown in FIGS. 1 and 6, container base and tray 100 includes container securing portion 102 and a surrounding portion, such as tray portion 104 as shown in FIG. 1 or tote portion 304 as shown in FIG. 6. Container base and tray 100 also has bottom 106 which, according to some embodiments, may be textured, providing an increased coefficient of friction between bottom 106 and the surface contacting bottom 106 (as compared to the coefficient of friction between a surface contacting bottom 106 with no texture). When in use, the increased coefficient of friction aides in preventing movement of container base and tray 100 along the surface contacting bottom 106.

Figure 2A:
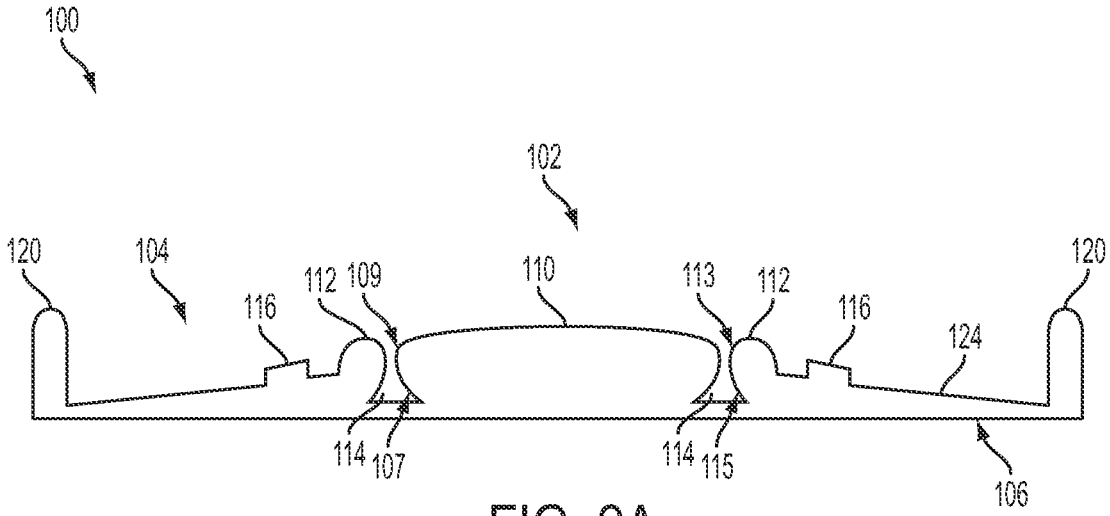
FIG. 2A is a cross-sectional view of an exemplary embodiment of a container base and tray according to the instant disclosure.
Figure 2B:
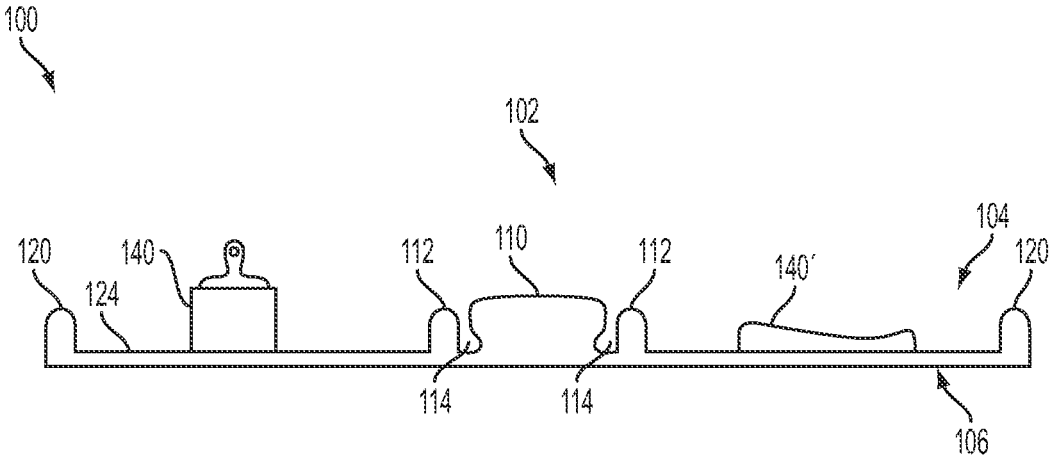
FIG. 2B is another cross-sectional view of an exemplary embodiment of a container base and tray according to the instant disclosure.

Tray portion 104 of container base and tray 100 may be comprised of plastic, fabric, or metal, or an alloy thereof, or may be comprised of a combination of any of plastic, fabric, or metal. Tray portion 104 includes tray floor 124 and edge 120. According to some embodiments, such as illustrated in FIGS. 1, 2A, and 2B, edge 120 may be raised, for example, by as little as ¼ inch or by as much as 3 or more inches, or any amount therebetween. Additionally, in some embodiments of container base and tray 100, edge 120 may include grip region 128. Grip region 128 may comprise a handle area defined by edge 128, for example, as illustrated in FIG. 1. Other embodiments of grip region 128 may comprise a handle-like structure being affixed to, or coupled to, edge 120. In embodiments of container base and tray 100 which do not include a raised edge 120, grip region 128 may be attached to, or defined by, tray floor 124 of tray portion 104 (such embodiments are not depicted herein).

With reference to FIGS. 2A and 2B, tray floor 124 of tray portion 104 may be sloped (FIG. 2A) or may be substantially flat (FIG. 2B). For example, as depicted in FIG. 2A, tray floor 124 may be sloped such that tray floor 124 is raised adjacent to container securing portion 102 (as compared to edge 120 of tray portion 104). In other embodiments of the present disclosure, for example as shown in FIG. 2B, tray floor 124 may be substantially flat. Further, tray floor 124 may also include embodiments having both a sloped region or area, and a region which is substantially flat.

It should also be understood that tray floor 124 of tray portion 104 may comprise any thickness, and may consist of regions or areas having varying thicknesses. For example, tray floor 124 may be relatively thin and non-rigid, for example, such as with a plastic trash bag or the like. Such an embodiment, as with a trash bag, will generally not retain its shape when picked up and moved from one work location to another work location. According to other configurations of container base and tray 100, tray floor 124 may comprise a thickness (and/or rigidity) capable of substantially retaining (or sustaining) the shape of container base and tray 100 when picked up and moved from one work location to another.

Continuing with FIGS. 2A and 2B, similar to bottom 106, tray floor 124 may also include a textured surface. For example, tray floor 124 may include a texture providing an increased coefficient of friction between tray floor 124 and one or more work tools, such as a paint brush or stir stick, placed in contact with tray floor 124. The increased coefficient of friction aides in preventing a work tool, which is placed in contact with tray floor 124, from sliding. For example, a worker may place a portion of a stir stick (e.g., an end previously dipped into paint) in contact with tray floor 124, and place the other end (e.g., the end used as the handle) along a raised edge 120 of tray portion 104. Tray floor 124 having texture aides in preventing the stir stick from sliding along tray floor 124, thereby decreasing the risk of the handle of the stir stick falling onto tray floor 124 and potentially causing the handle to get paint on it.

With reference to FIG. 2B, exemplary embodiments of container base and tray 100 are depicted in which tray portion 104 includes one or more moulds 140, 140'. As with other components of tray portion 104, moulds 140, 140' may be comprised of plastic, metal, or alloys thereof and/or mixtures thereof. With reference to the exemplary embodiment of mould 140, a raised structure is shown capable of holding one or more work tools, such as paint brushes, rollers, paint sticks, paper towel rolls, or the like. The exemplary embodiment of mould 140' shown in FIG. 2B defines a structure capable of securing a paint tray, for example, in place on tray floor 124. For example, mould 140' may define a disposable paint roller insert holder, capable of having a disposable paint roller inserted thereon and holding the insert in place when paint is applied to a roller. Further, mould 140' may comprise brackets which hold a base (for a paint roller insert) in place when paint is applied to a roller. It should be understood that moulds 140, 140' may take any of a number of forms and shapes. Also, according to the instant disclosure, moulds 140 may be defined by container base and tray 100 or attached to container base and tray 100, for example, at tray floor 124.

Returning briefly to FIG. 1, tray portion 104 may also comprise one or more compartment 122 (denoted as 122A, 122B, 122C, and 122D in FIG. 1). As shown in FIG. 1, compartments 122 may define distinct areas of tray floor 124. Each individual compartment 122 may be separated from the other compartments 122 by one or more compartment separators 126 (denoted as 126A, 126B, 126C, and 126D in FIG. 1), which may be a raised portion of tray floor 124 or may comprise a separate structure. Embodiments of container base and tray 100 are also possible in which each individual compartment 122 of tray portion 104 may comprise differing characteristics. For example, compartments 122 may include varying slopes, thickness, and texture of tray floor 124.

As explained above, container base and tray 100 includes container securing portion 102. Although illustrated as a substantially round shape, it should be understood that container securing portion 102 may comprise any shape suitable for securing a liquid container having a square, rectangular, round, oval, or polygonal shape, thereto. As with tray portion 104, container securing portion 102 may be comprised of plastic, metal, or an alloy thereof, or a combination of plastic and metal.

Figure 3A:
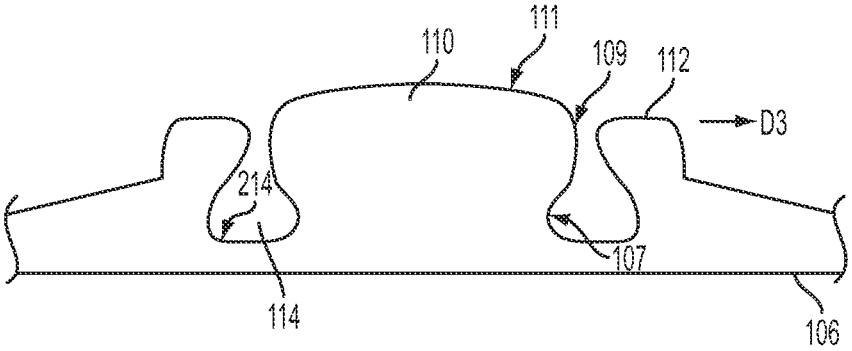
FIG. 3A is a cross-sectional view of an exemplary container securing portion of a container base and tray according to the instant disclosure.
Figure 3B:
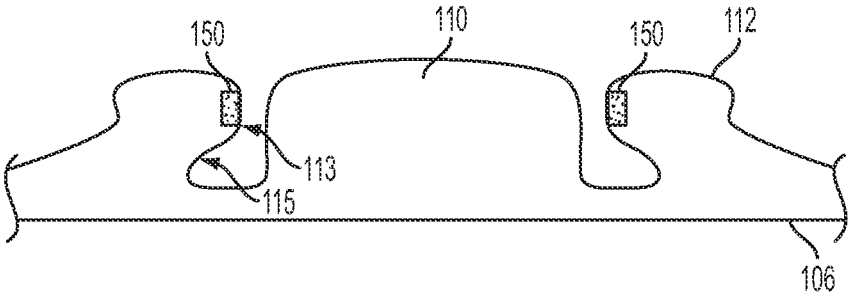
FIG. 3B is another cross-sectional view of an exemplary container securing portion of a container base and tray according to the instant disclosure.

Referring to FIGS. 3A and 3B, container securing portion 102 includes inner container securing portion 110, outer container securing portion 112, and groove 114. As depicted in FIGS. 3A and 3B, inner container securing portion 110 may comprise any of a number of shapes. For example, as shown in FIG. 3A, inner container securing portion 110 (when not in use) may have a rounded top surface 111 (that extends above the upper most portion of outer container securing portion 112). Additionally, as shown in FIG. 3A, the upper region 109 of inner container securing portion 110 may be wider than the lower region 107 of inner container securing portion 110. In use, upper region 109 of the configuration of inner container securing portion 110 shown in FIG. 3A applies force F5 (FIG. 3D) along the bottom and rim of a liquid container. Other embodiments of container base and tray 100, such as shown in FIG. 3B, may include top surface 111 of inner container securing portion 110 being substantially the same height as outer container securing portion 112 and the width of upper and lower regions 109, 107, of inner container securing portion 110 being substantially the same in width throughout.

Figure 3C:
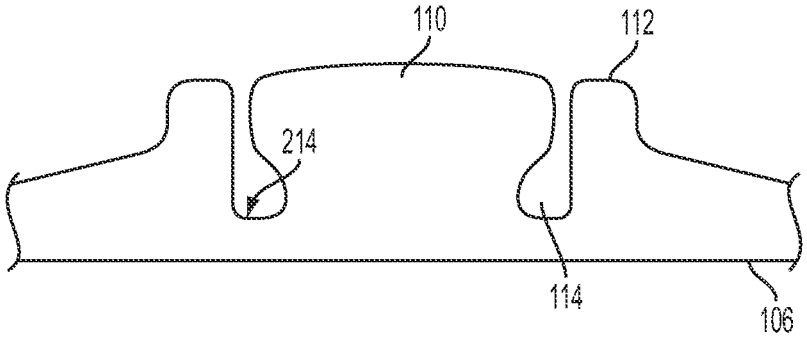
FIG. 3C is yet another cross-sectional view of an exemplary container securing portion of a container base and tray according to the instant disclosure.

Referring to FIGS. 3B and 3C, outer container securing portion 112 may also take various forms. For example, as shown in FIG. 3B, upper region 113 of outer container securing portion 112 may be closer to inner container securing portion 110 than lower region 115 (width at upper region 113 may also be greater than lower region 115). Additionally, as shown in FIG. 3C, configurations of outer container securing portion 112 in which upper region 113 and lower region 115 are substantially the same distance away from the inner container securing portion 110 are also possible.

Further, as shown specifically in FIG. 3B, outer container securing portion 112 may include securing component 150. Securing component 150 may include a band or ring-like structure which acts to enhance the securing of securing portion 102 to the container. According to configurations of container base and tray 100, securing component 150 may be comprised of one or more of rubber, metal, fabric, or an alloy of any or some of these materials. Further, securing component 150 may comprise a portion of, or be disposed within, outer container securing portion 112. For example, according to embodiments of container base and tray 100, similar to the embodiment depicted in FIG. 3B, securing component 150 may be disposed within outer container securing portion 112. In use, securing component 150 functions to pull outer container securing portion 112 closer to inner container securing portion 110. Thus, when a container is placed within container securing portion 102, securing component 150 aides in firmly securing outer container securing portion 112 to the side wall and/or rim of the container.

Figure 4:
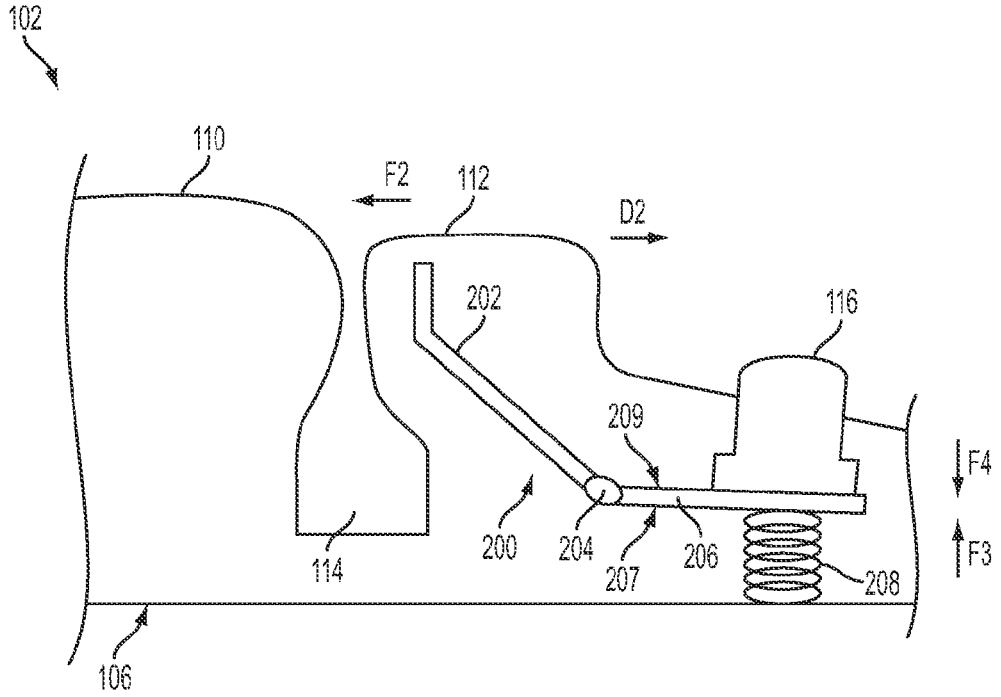
FIG. 4 is a cross-sectional view of a portion of an exemplary container securing portion of a container base and tray according to the instant disclosure.

Other configurations of container base and tray 100, such as depicted in FIG. 4, may also include a securing bracket 200. According to such embodiments, inward portion 202 of securing bracket 200 may comprise part of (or be disposed within) outer container securing portion 112 of container securing portion 102.

In use, inward portion 202 of securing bracket 200 applies inward force F2 to outer container securing portion 112, causing outer container securing portion 112 to be pushed against the side wall and/or rim of a container disposed within container securing portion 102. According to the exemplary embodiment shown in FIG. 4, securing bracket 200 may comprise pivot pin 204, about which securing bracket 200 rotates. Outward portion 206 of securing bracket 200 may be contacted by spring 208 or other resilient member along a portion of bottom surface 207 whereby spring 208 exerts upward force F3 on bottom surface 207. Upward force F3 on outward portion 206 causes securing bracket 200 to rotate about pivot pin 204 such that inward portion 202 applies inward force F2 to outer container securing portion 112.

Remaining with FIG. 4, release 116' (described in more detail below) may be pushed downward, thereby applying downward force F4 to upper surface 209 of outward portion 206. If downward force F4 on outward portion 206 is greater than upward force F3 on outward portion 206, spring 208 will be compressed and securing bracket 200 will rotate about pivot pin 204. Rotation of securing bracket 200 relieves (or at least reduces) inward force F2 on outer container securing portion 112, allowing the container to be removed from within container securing portion 102.

Figure 3D:
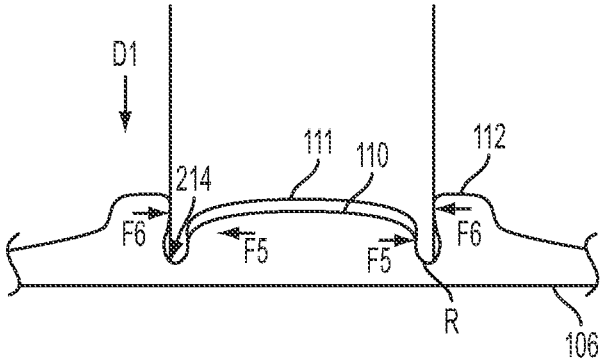
FIG. 3D is even yet another cross-sectional view of an exemplary container securing portion of a container base and tray according to the instant disclosure shown with a lower portion and rim of a container secured therein.

Referring next to FIG. 3D, an exemplary embodiment of container securing portion 102 having a container secured therein is shown. As shown, the bottom rim R of the container rests on upper surface 214 of groove 114 of container securing portion 102. As is further shown, the weight of the bottom rim R of the container displaces the upper surface 214 of groove 114 downward in direction D1. As should be understood, the amount of displacement of upper surface 214 of groove 114 is dependent on the weight of the container, and the rigidity of the material comprising groove 114 (e.g., the heavier the weight of container and the lower the rigidity of the material comprising groove 114 will, in general, lead to greater displacement of upper surface 214 of groove 114). Further, as can be seen in FIG. 3D, in some configurations of container base and tray 100, displacement of groove 114 in direction D1 may create resultant forces F5 acting on inner container securing portion 110, and resultant forces F6 acting on outer container securing portion 112. Thus, in at least some embodiments of container base and tray 100, the weight of a container and/or the rigidity of the material comprising groove 114, can lead to displacement of upper surface 214 of groove 114 and thereby enhance the strength with which container base and tray 100 secures a container thereto.

Referring next to FIGS. 2A and 4, some embodiments of container base and tray 100 may include one or more releases 116, 116'. As shown in FIG. 2A, release 116 may comprise a raised portion of tray floor 124, such as a moulded portion of, or a piece added to, tray floor 124. In some configurations of container base and tray 100, such as shown in FIG. 2A, release 116 is disposed adjacent to outer container securing portion 112 and may be positioned at a portion of tray floor 124 which is raised (for example, if tray floor 124 is sloped).

In other configurations of container base and tray 100, for example as shown in FIG. 4, release 116' may include a button which protrudes from tray floor 124. As illustrated, release 116' may contact upper surface 209 of outward portion 206 of securing bracket 200. Outward portion 206 of securing bracket 200, as shown in FIG. 4, is acted upon by upward force F3 from spring 208. A worker however, may overcome upward force F3 by pressing (applying a downward force) on release 116', which in turn applies downward force F4 to upper surface 209 of outward portion 206 of securing bracket 200. As explained above, when downward force F4 acting on outward portion 209 is greater than upward force F3 acting on outward portion 209, securing bracket 200 rotates about pivot pin 204. Rotation of securing bracket 200 about pivot pin 204 creates a reduction in force F2 (generated by securing bracket 200) acting on (or within) outer container securing portion 112. The reduction in force F2 enables outer container securing portion 112 to more easily displace in direction D2 during removal of the liquid container. It should be understood that outer container securing portion 112 may either move in direction D2 with inward portion 202 of securing bracket 200 or as bottom rim R of container is removed from container securing portion 102.

In addition to embodiments of container base and tray 100 having one or more releases 116, some embodiments of container base and tray 100 may not comprise a release 116. For example, with reference to FIG. 3A, container base and tray 100 does not include a release 116. In such embodiments, outer container securing portion 112 (and/or inner container securing portion 110) may be comprised of material having elasticity or otherwise be biased into an initial shape such that when the liquid container is removed, one or both of outer container securing portion 112 and inner container securing portion 110 are displaced away from the side wall and rim of the container, allowing the container to be removed. Additionally, such embodiments, such as shown in FIG. 3A, may include tray floor 124 being raised adjacent to outer container securing portion 112. In some embodiments, such as depicted in FIG. 3A, an area of tray floor 124 adjacent to outer container securing portion 112 may be pressed downward, thereby causing outer container securing portion 112 to be displaced in direction D3.

Figure 5A:
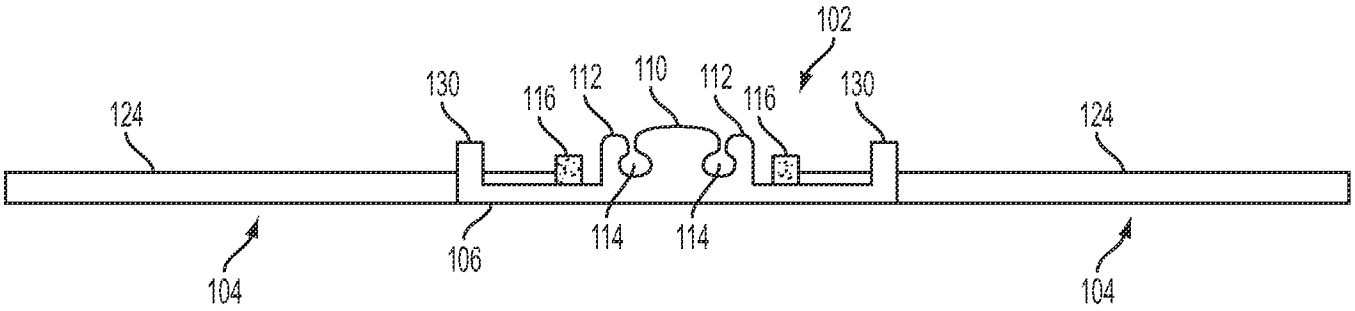
FIG. 5A is a cross-sectional view of an exemplary embodiment of a container base and tray according to the instant disclosure having a separate container securing portion which is connectable to a tray portion.
Figure 5B:
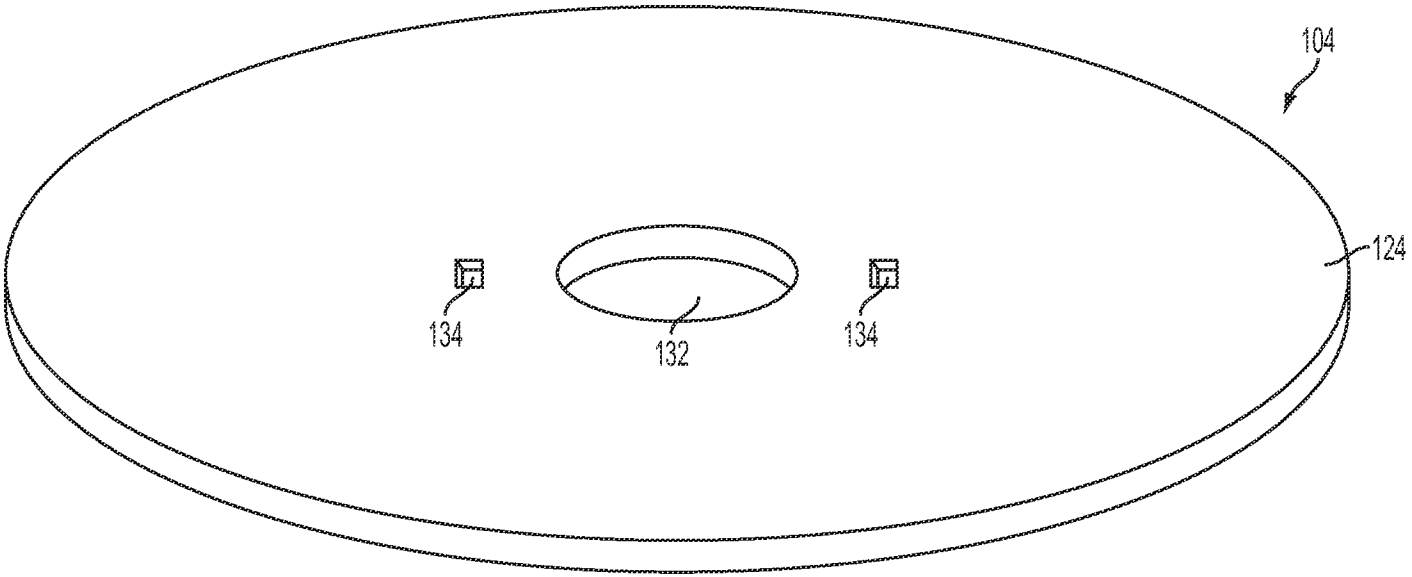
FIG. 5B is a perspective view of a tray portion of an exemplary embodiment of a container base and tray according to the instant disclosure having a separate tray portion which is connectable to a container securing portion.

Referring next to FIGS. 5A and 5B, in some configurations of container base and tray 100, container securing portion 102 and tray portion 104 may be separate, connectable, components of container base and tray 100. In such embodiments tray portion 104 may include container aperture 132. Container aperture 132 is, in general, large enough to allow the container (secured to container securing portion 102) to pass through. Container aperture 132 may also be large enough to allow at least a portion of container securing portion 102 to pass therethrough, such as shown in FIG. 5A. Additionally, tray portion 104 may also include one or more connection apertures 134 which allow one or more connection extensions 130 to pass therethrough, thereby further securing tray portion 104 to container securing portion 102 such that container base and tray 100 can be moved by a worker (as described herein) while container securing portion 102 and tray portion 104 remain connected.

In use, a container is secured to container securing portion 102 of container base and tray 100 in any of the manners described above. Container securing portion 102 is secured to the container such that a worker may move the container, for example by way of lifting on the handle of the container (e.g., lifting a gallon of paint by the paint container handle), from a first work location to a second work location (e.g., a first room in a house to a second room in the house). According to the instant disclosure, container base and tray 100 remains securely attached to the lower portion of the container during the worker's transfer of the container, such that when the container is moved container base and tray 100 also moves.

In an exemplary use of container base and tray 100, a worker may hold a paint container (by holding the handle of the container) having container base and tray 100 secured thereto, while applying paint to a wall, for example. Container base and tray 100 thereby allows the worker to keep the paint container and container base and tray 100 close to the worker during painting, and allows the worker to keep one hand free for painting. Additionally, embodiments of container base and tray 100 including one or more of the various moulds 140 described herein allows a worker to easily switch between tools, such as paint brushes, without requiring the user to put the paint container down.

Further, configurations of container base and tray 100 also secure a container (for example, a large container of paint) to container securing portion 102, such that if a worker moves (e.g., pushes or pulls) container base and tray 100, for example using gripping region 128, the container is stabilized (reducing the risk of spilling or tipping the container). As such, a user may utilize container base and tray 100 in either an indoor or outdoor environment, and with a small or large container (such as a ten gallon, or more, drum of paint). A worker may then move a large container of paint, for example, by pulling container base and tray 100 while container base and tray 100 stabilizes the container preventing it from tipping or spilling.

Referring next to FIGS. 6-12, in some embodiments, the container base and tray 100 is a container base and paint tote 300 including tote portion 304. Tote portion 304 includes one or more compartments 322 to hold tools such as paint brush 318, paint roller 319, and the like. With reference to FIG. 6, an exemplary embodiment of container base and paint tote 300 is depicted. Although depicted as comprising a rectangle, it should be understood that container base and paint tote 300 may comprise any shape, including but not limited to a square, an oval, a circle, and any other polygonal shape.

Container 306 is positioned in container securing portion 302. In one embodiment, container 306 is a paint can, although other suitable containers 306 having contents of any physical state including solids (such as concrete mix), stains, coatings, and other suitable liquids. Although illustrated as a substantially round shape, it should be understood that container securing portion 302 may comprise any shape suitable for securing a liquid container having a square, rectangular, round, oval, or polygonal shape, thereto. Container securing portion 302 may be comprised of plastic, metal, or an alloy thereof, or a combination of plastic and metal.

In one embodiment, container securing portion 302 includes means for securing container 306 to container base and paint tote 300. Exemplary means for securing container 306 to container base and paint tote 300 include inner container securing portion 110, outer container securing portion 112, groove 114, securing component 150, and securing bracket 200, In an exemplary embodiment, the container securing portion 302 has an outer and inner securing portion which define a groove and which function together to secure container 306, such as a paint container, to the container securing portion 302. In one embodiment, container 306 is secured in the groove through friction with the outer and inner securing portions. In another embodiment, container base and paint tote 300 includes a container release component which is disposed adjacent to the outer securing portion of the container securing portion 302 and aides in releasing container 306 secured within the container securing portion 302. In still another embodiment, container base and paint tote 300 may include one or more securing brackets which act to exert an inward force on outer container securing portion. The securing bracket may be spring loaded and may rotate about a pivot pin when a downward force is exerted on an outward portion of the securing bracket by a container release component. Other exemplary means may include a securing component, which may include a band or ring-like structure which acts to enhance the securing of container securing portion 302 to container 306, or a securing bracket.

Securing container 306 to container base and paint tote 300 allows a user to move and position container base and paint tote 300 using only a handle on container 306. Additionally, securing container 306 to container base and paint tote 300 provides a wider and more stable base for container 306, making it more difficult to tip over and spill its contents.

Tote portion 304 includes tray floor 324 and edge 320. Edge 320 is similar to edge 120 and may be raised, for example, by as little as ¼ inch or by as much as 3 or more inches, or any amount therebetween. At least one edge 320 may include grip 328. Separate grips 328 may be found at opposite ends of container base and paint tote 300. Although depicted as a substantially rectangular opening, grip 328 may comprise any shape, including oval or having curved finger-hold regions. Grip 328 may be a recess or externally secured, affixed, or coupled to at least one edge 320 rather than be an opening in edge 320.

Container base and paint tote 300 also has bottom 307, similar to bottom 106, which, according to some embodiments, may be textured, providing an increased coefficient of friction between bottom 307 and the surface contacting bottom 307 (as compared to the coefficient of friction between a surface contacting bottom 307 with no texture). When in use, the increased coefficient of friction aides in preventing movement of container base and paint tote 300 along the surface contacting bottom 307.

Tote portion 304 of container base and paint tote 300 may be comprised of plastic, fabric, or metal, or an alloy thereof, or may be comprised of a combination of any of plastic, fabric, or metal. Other suitable materials, including but not limited to fiberglass, resins, and polymeric materials, may also be used.

Tote portion 304 includes one or more compartments 322 separated by a plurality of compartment separators 326, which may be a raised portion of tray floor 324 or may comprise a separate structure. Embodiments of container base and paint tote 300 are also possible in which each individual compartment 322 of tote portion 304 may comprise differing characteristics. For example, compartments 322 may include varying slopes, thickness, and compartment separators 326 may include different heights and thicknesses. In the exemplary embodiment illustrated in FIG. 6, tray or tote portion 304 includes six compartments 322. More or fewer compartments may be formed in tray or tote portion 304. In FIG. 6, four of the compartments are smaller, 322A, and two are larger, 322B. In one embodiment, the smaller compartments 322A are configured to support a paint brush 318 and the larger compartments are configured to support a paint roller 319. In other embodiments, compartments 322 may configured to support one or more work tools, such as paint brushes, rollers, paint sticks, paper towel rolls, or the like. In still other embodiments, tray portion 104 or tote portion 304 may include a roller tray, such as roller tray 330 in FIG. 10.

Figure 7:
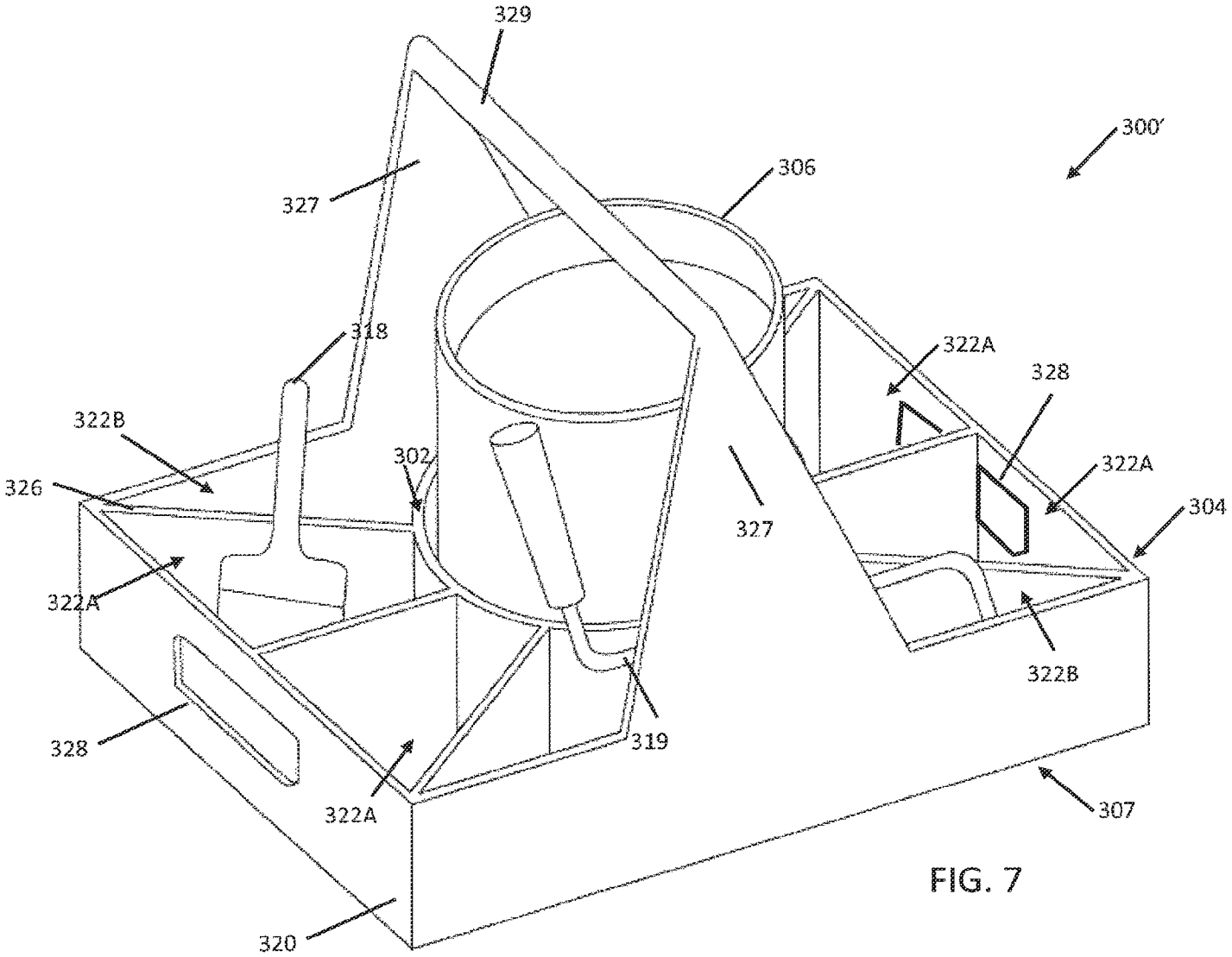
FIG. 7 is a perspective view of another exemplary embodiment of a container base and tote according to the instant disclosure.

Referring next to FIG. 7, another exemplary embodiment of container base and paint tote 300' is depicted. Container base and paint tote 300' is similar to container base and paint tote 300 as shown in FIG. 6. Container base and paint tote 300' further includes handle 329. As illustrated, handle 329 is attached to projections 327. In the embodiment illustrated in FIG. 7, projections 327 are formed as part of edge 320, but projections 327 may also be attached to edge 320 or bottom 306 in other embodiments. Projections 327 are sized to allow container 306 to be positioned in container securing portion 302 under handle 329.

Figure 8:
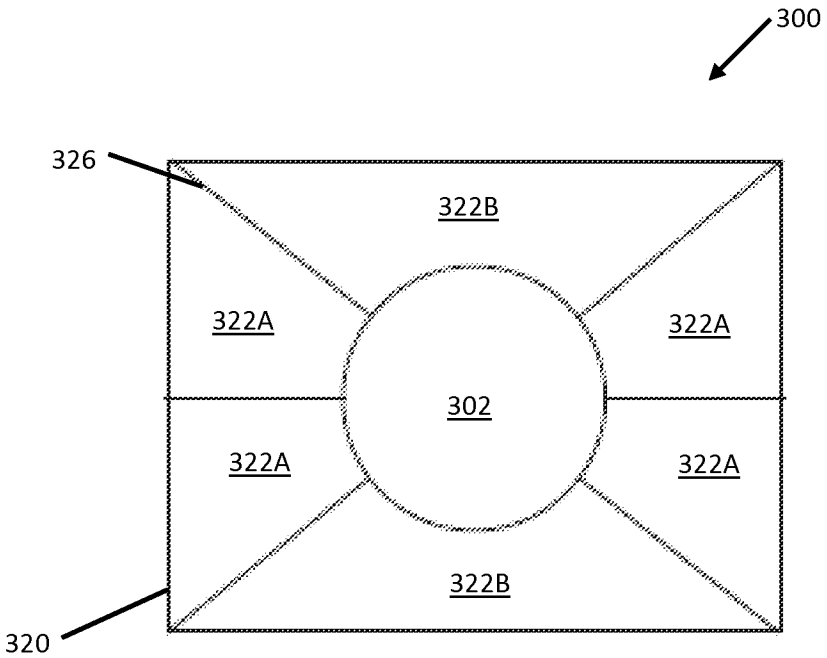
FIG. 8 is a top view of the exemplary embodiment of FIG. 6.

Referring next to FIG. 8, a top view of the exemplary embodiment of FIG. 6 is illustrated. Container securing portion 302 of container base and paint tote 300 is surrounded by a plurality of compartment separators 326. Compartment separators 326 and edge 320 cooperate to form smaller compartments 322A and larger compartments 322B.

Figure 9:
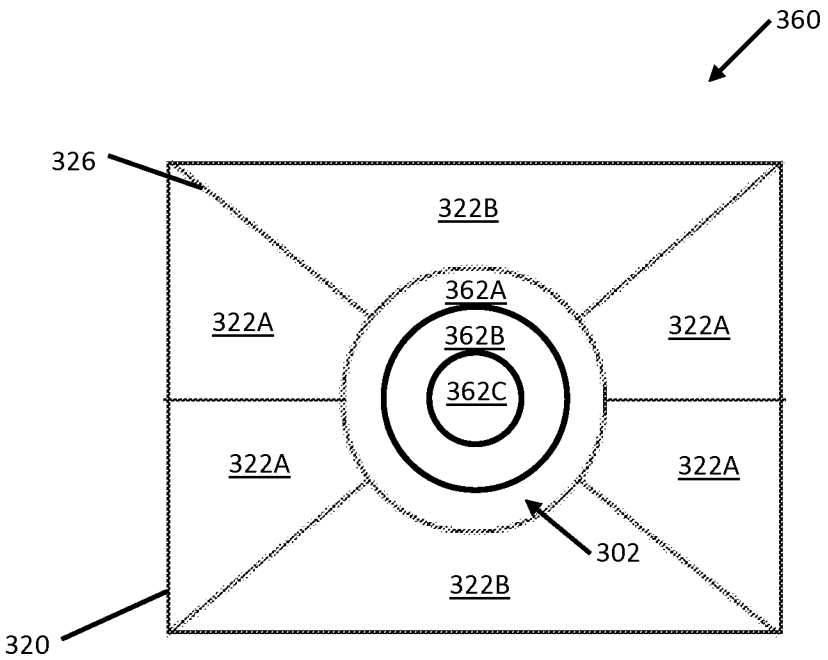
FIG. 9 is a top view of an exemplary embodiment of a container base and tote according to the instant disclosure.

Referring next to FIG. 9, a top view of another exemplary embodiment of a container base and tote 360 is illustrated. The embodiment in FIG. 9 is similar to that shown in FIG. 8. Container base and tote 360 includes a plurality of compartment separators 326 and edge 320 cooperating to form smaller compartments 322A and larger compartments 322B. Container securing portion 302 includes a plurality of sized means 362 for securing containers to container base and tote 360. As illustrated, container base and tote 360 includes three different sized means 362, labelled 362A, 362B, and 362C, but more or fewer different sized means may be used.

Exemplary means 362 include an outer and inner securing portion which define a groove and which function together to secure container 306, such as a paint container, to the container securing portion 302. In another embodiment, a container release component is disposed adjacent to the outer securing portion of the container securing portion 302 and aides in releasing container 306 secured by means 362. In still another embodiment, means 362 may include one or more securing brackets which act to exert an inward force on outer container securing portion. The securing bracket may be spring loaded and may rotate about a pivot pin when a downward force is exerted on an outward portion of the securing bracket by a container release component. Other exemplary means may include a securing component, which may include a band or ring-like structure which acts to enhance the securing of container securing portion 302 to container 306, or a securing bracket.

In one embodiment, first means 362A is sized to accept a first sized container 306. Second means 362B is formed concentrically to first means 362A and is configured to accept a smaller container base than first means 362A. Second means 362B is positioned below first means 362A to allow a first container 306 to be secured to first means 362A. Similarly, third means 362B is formed concentrically to first means 362A and 362B and is configured to accept a smaller container base than second means 362B. Third means 362C is positioned below first means 362A and second means 362B to allow a container to be secured to second means 362B.

In another embodiment, means 362A, 362B, and 362C are cylindrical sleeves. The interior surface of first means 362A is sized to secure a first sized container 306. Second means 362B is sized such that the exterior surface of second means 362B fits within the interior of first means 362A and the interior surface of second means 362B is sized to secure a second sized container 306, smaller than first sized container. Similarly, third means 362C is sized such that the exterior surface of third means 362C fits within the interior of second means 362B and the interior surface of second means 362C is sized to secure a third sized container 306, smaller than the first sized container and second sized container. When a first sized container is to be placed in container securing portion 302, second means 362B and third means 362C are removed. Similarly, when a second sized container is to be placed in container securing portion 302, third means 362C is removed. In one embodiment, the cylindrical sleeves are fastened to each other when in place. In another embodiment, the cylindrical sleeves are held in place by friction between the inner and outer surfaces of adjacent cylinders. Other suitable means for securing container 306 to container securing portion 302 may also be used.

In another exemplary embodiment, one or more of means 362A, 3628, and 362C includes a container securing portion 110. In still another exemplary embodiment, one or more of means 362A, 362B, and 362C forms outer container securing portion 112 and are positioned on container base and tray 100.

Figure 10:
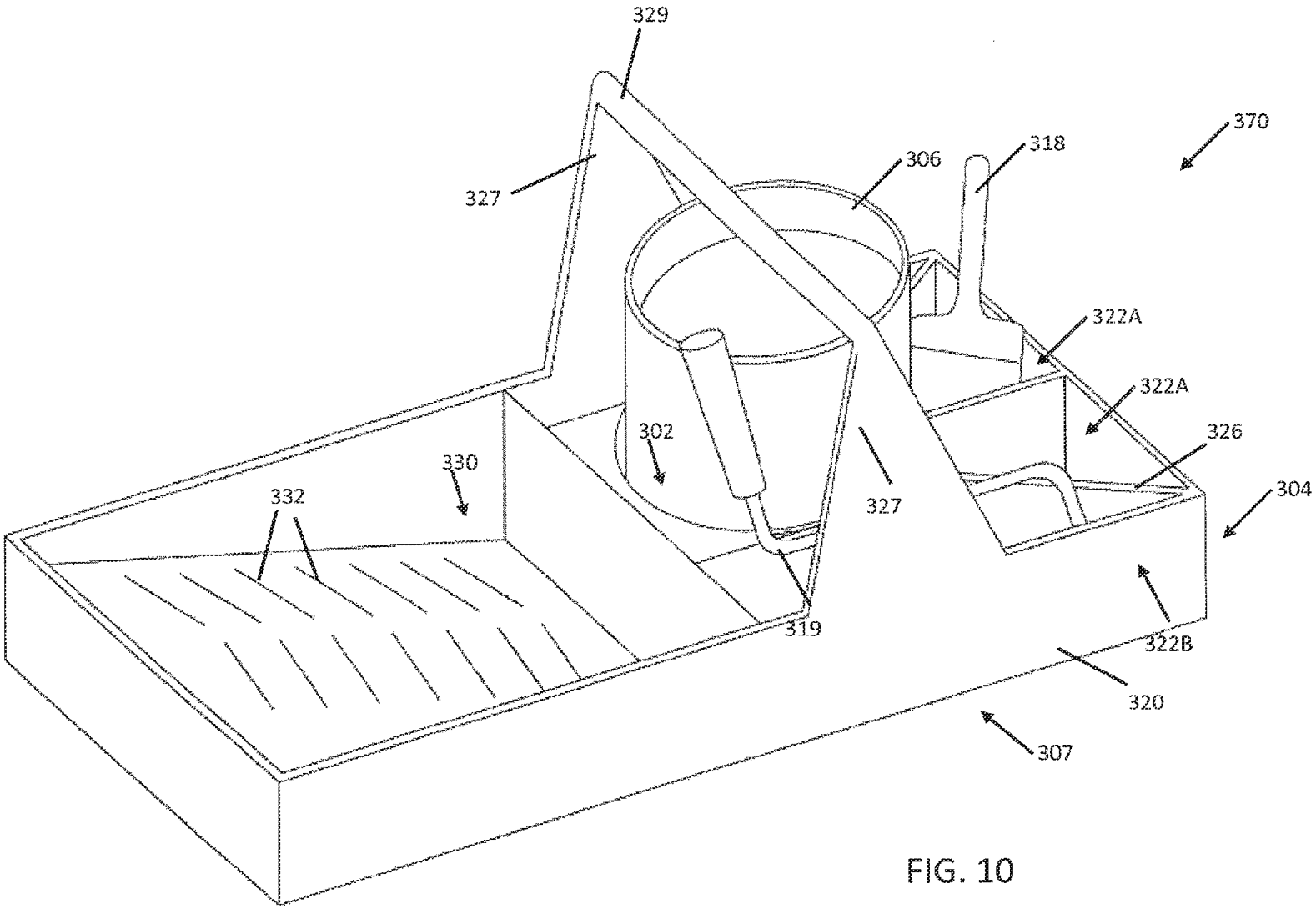
FIG. 10 is a perspective view of another exemplary embodiment of a container base, tote, and tray according to the instant disclosure.

Referring next to FIG. 10, another exemplary embodiment of container base, tote and tray 370 is depicted. Container base, tote, and tray 370 is similar to container base and paint tote 300'. Container base, tote, and tray 370 includes handle 329. As illustrated, handle 329 is attached to projections 327. In the embodiment illustrated in FIG. 7, projections 327 are formed as part of edge 320, but projections 327 may also be attached to edge 320 or bottom 306 in other embodiments. Projections 327 are sized to allow container 306 to be positioned in container securing portion 302 under handle 329.

Container base, tote, and tray 370 also include roller tray 330. In one embodiment, roller tray 330 is configured to accept a paint roller, such as paint roller 319. The bottom of roller tray 330 may be sloped, such that it slopes towards an edge away from container securing portion 302. Roller tray 330 may also include a plurality of ridges 332 to assist in removing excess paint from a paint roller 319. Ridges 332 may be angled, as illustrated in FIG. 10, or ridges 332 may be straight, V-shaped, or other suitable shapes.

Figure 11:
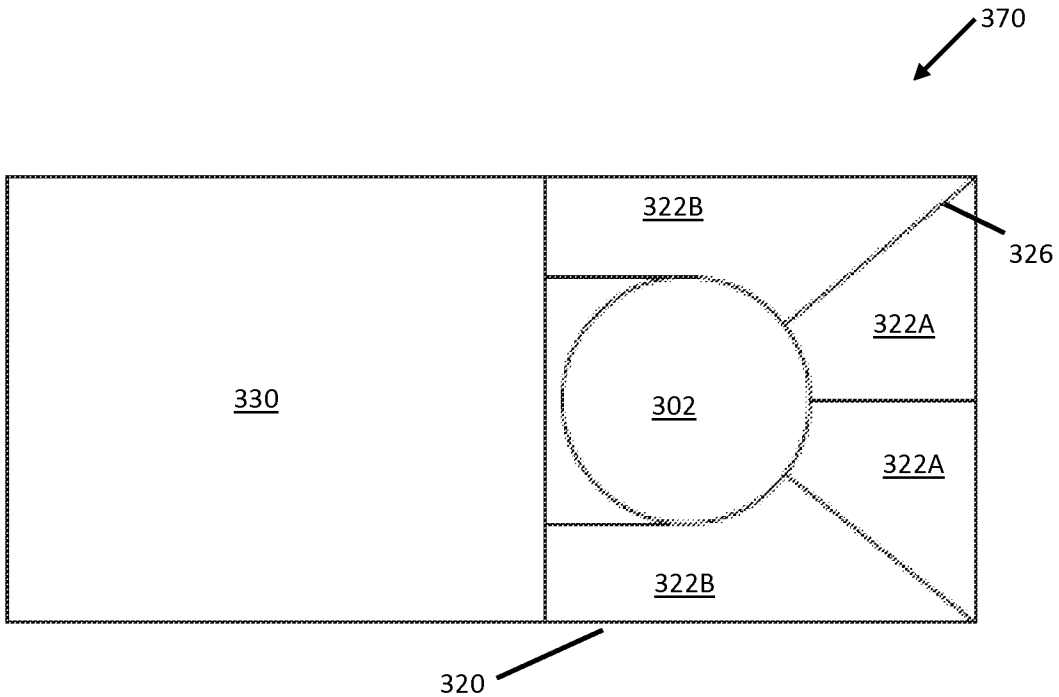
FIG. 11 is a top view of the exemplary embodiment of FIG. 10.

Referring next to FIG. 11, a top view of the exemplary embodiment of FIG. 10 is illustrated. Container securing portion 302 of container base, tote and tray 370 is surrounded by a plurality of compartment separators 326. Compartment separators 326 and edge 320 cooperate to form smaller compartments 322A and larger compartments 322B. Compartment separators 326 and edge 320 also cooperate to form roller tray 330. In one embodiment, container securing portion 302 includes means for securing container 306 to container base and paint tote 300.

Figure 12:
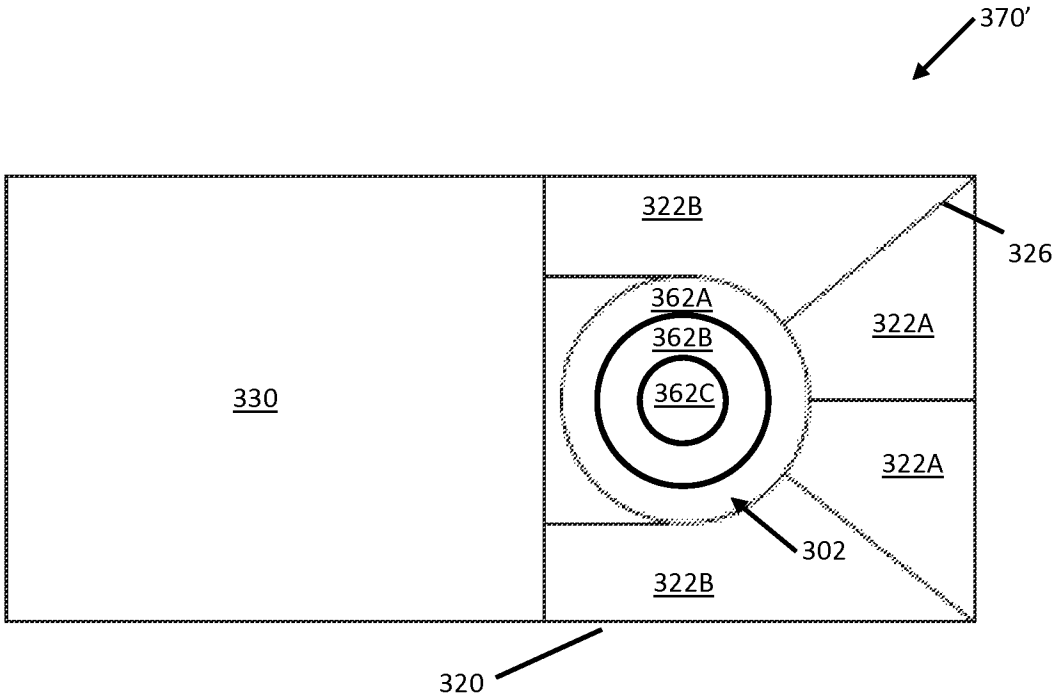
FIG. 12 is a top view of another exemplary embodiment of a container base, tote, and tray according to the instant disclosure.

Referring next to FIG. 12, a top view of another exemplary embodiment of a container base, tote, and tray 370' is illustrated. The embodiment in FIG. 12 is similar to that of FIG. 11. Container base, tote, and tray 370' includes a plurality of compartment separators 326 and edge 320 cooperating to form smaller compartments 322A, larger compartments 322B, and roller tray 330. Similar to FIG. 9, container securing portion 302 includes a plurality of sized means 362 for securing containers to container base, tote, and tray 370'. As illustrated, container base, tote, and tray 370' includes three different sized means 362, labelled 362A, 3628, and 362C, but more or fewer different sized means may be used. Exemplary means 362 are as disclosed above for container base and tote 360 as shown in FIG. 9.

In one embodiment, first means 362A is sized to accept a first sized container 306. Second means 362B is formed concentrically to first means 362A and is configured to accept a smaller container base than first means 362A. In one exemplary embodiment, second means 362B is positioned below first means 362A to allow a container 306 to be secured as disclosed above for FIG. 9. In another exemplary embodiment, second means 362B is a cylindrical sleeve positioned inside first means 362A to allow a container 306 to be secured as disclosed above for FIG. 9. Other suitable means for securing container 306 to container securing portion 302 may also be used.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within the known or customary practice in the art to which this disclosure pertains.

What is claimed is:

1. A base for a container comprising:

a container securing portion having an outer securing portion and an inner securing portion, the outer and inner securing portions defining a groove, the outer container securing portion having an upper region and a lower region, the upper region being closer to the inner container securing portion than the lower region, the container securing portion being configured to couple a container having a bottom rim positioned in the groove to the container securing portion by applying at least one force to the bottom rim of the container, wherein the container securing portion is configured such that a weight of the bottom rim of the container on an upper surface of the groove creates a first force from the inner securing portion on the container and a second force from the outer securing portion on the container;

a securing bracket positioned within the outer securing portion, the securing bracket configured to apply an inward force against a container coupled to the base, wherein the securing bracket does not extend above the outer container securing portion;

a surrounding portion extending outwardly from the container securing portion, the surrounding portion disposed around the container securing portion; and a container release component disposed adjacent the outer securing portion of the container securing portion.

2. The base of claim 1, wherein the container securing portion and surrounding portion are separate components of the base, the container securing portion including at least one aperture configured to allow a portion of the container to pass therethrough.

3. The base of claim 2, wherein the surrounding potion includes at least one connection aperture and the container securing portion includes at least one extension, the extension configured to pass through the connection aperture to secure the container securing portion to the surrounding portion.

4. The base of claim 1 further comprising a handle attached to the surrounding portion, wherein the handle extends between a first side of the surrounding portion to a second side of the surrounding portion over at least a portion of the container securing portion.

5. The base of claim 1, wherein the surrounding portion is a tray including a raised outer edge.

6. The base of claim 5, wherein the surrounding portion further includes a plurality of compartment separators extending from the container securing portion to the raised outer edge and defining a plurality of compartments.

7. The base of claim 1, wherein at least a portion of a bottom surface of the base is textured.

8. The base of claim 1, wherein at least a portion of a top surface of the surrounding portion is textured.

9. The base of claim 1, wherein the container securing portion further includes means for securing a first container having a first sized base, and means for securing a second container having a second sized base, the second sized base being smaller than the first sized base, the means for securing the second container being positioned below the means for securing the first container.

10. The base of claim 1, wherein the container securing portion further includes a first cylindrical sleeve configured to secure a first container having a first diameter and a second cylindrical sleeve positioned concentrically with the first cylindrical sleeve, the second cylindrical sleeve configured to secure a second container having a second diameter smaller than the first diameter, the second cylindrical sleeve being positioned below the first cylindrical sleeve.

11. The base of claim 1, wherein the inner securing portion includes a rounded top surface extending above an upper most portion of the outer securing portion.

12. The base of claim 1, wherein the inner securing portion includes an upper region and a bottom region defining the groove, the upper region being wider than the bottom region.

13. The base of claim 1, wherein the container release component is configured to release the inward force applied against the container by the securing bracket when the container release component is depressed.

14. The base of claim 1, further comprising a pivot pin about which the securing bracket rotates, the securing bracket configured to reduce the inward force on a container positioned in the base when the securing bracket is rotated about the pivot pin by depressing the container release component.

15. A base for a container comprising:

means for securing a container positioned in a groove of the base to the base by applying at least one force to a bottom rim of the container, the means for securing the container comprising an outer securing portion and a securing bracket positioned within the outer securing portion, the securing bracket configured to apply an inward force against a container coupled to the base, wherein the securing bracket does not extend above the outer container securing portion;

a surrounding portion extending outwardly from the securing means, the surrounding portion disposed around the securing means; and means for releasing the container from the base positioned adjacent the securing means.

16. The base of claim 15, wherein said securing means further comprises means for securing a first container having a first sized and a means for securing a second container having a second sized base, the second sized base being smaller than the first sized base, the means for securing the second container being positioned below the means for securing the first container.

17. A base for a container comprising:

a container receiving portion having a first cylindrical sleeve having a first groove configured to secure a first container received within the groove, the first container having a first diameter and a second cylindrical sleeve positioned concentrically with the first cylindrical sleeve, the second cylindrical sleeve having a second groove configured to secure a second container received within the groove, the second container having a second diameter smaller than the first diameter, the second cylindrical sleeve being positioned below the first cylindrical sleeve, and a surrounding portion extending outwardly from the container securing portion, the surrounding portion disposed around the container securing portion and including a raised outer edge, the surrounding portion including a plurality compartment separators extending from the container securing portion to the raised outer edge, the compartment separators dividing the surrounding portion into a plurality of compartments;

wherein at least one of the first groove and the second groove is partially defined by an outer securing portion configured to apply at least one force to a bottom rim of the container received within the groove, the outer securing portion including a securing bracket positioned within the outer securing portion, the securing bracket configured to apply an inward force against the container received within the groove, wherein the securing bracket does not extend above the outer container securing portion.

18. The base of claim 17, wherein the surrounding portion is a tray.

19. The base of claim 17, wherein the surrounding portion is a tote including a roller tray having bottom that slopes towards an edge away from the container securing portion.

* * * * *